US006176439B1

(12) United States Patent
Masison

(10) Patent No.: US 6,176,439 B1
(45) Date of Patent: Jan. 23, 2001

(54) DEADMAN CONTROL METHOD AND APPARATUS

(75) Inventor: David Masison, Nothwood, NH (US)

(73) Assignee: P. K. Lindsay Co., Inc., Deerfield, NH (US)

( * ) Notice: Under 35 U.S.C. 154(b), the term of this patent shall be extended for 0 days.

(21) Appl. No.: 09/440,407

(22) Filed: Nov. 15, 1999

(51) Int. Cl.[7] ..... B05B 9/00

(52) U.S. Cl. ..... 239/124; 239/526; 239/569; 251/41

(58) Field of Search ..... 239/124, 99, 101, 239/569, 525, 526, 570; 251/41; 137/894, 892

(56) References Cited

U.S. PATENT DOCUMENTS 5,069,391 * 12/1991 Seaholtz ..... 239/526
5,216,848 * 6/1993 Abbott et al. ..... 239/525
5,239,787 * 8/1993 Abbott et al. ..... 239/526

* cited by examiner

*Primary Examiner*—Andres Kashnikow
*Assistant Examiner*—Lisa Ann Douglas
(74) *Attorney, Agent, or Firm*—Davis and Bujold

(57) ABSTRACT

An enhanced mixing equipment system including a power supply, an actuatable valve, the actuatable valve connected via a line between the power supply and a storage vessel, an actuatable discharge/mixing valve attached to a portion of the storage vessel, the actuatable discharge/mixing valve connected via a line between the actuatable valve and a hose, a terminal end of the hose having a nozzle, a control input line connecting the power supply to a control valve positioned adjacent to the nozzle, and a control return line having a safety bleed positioned adjacent to the actuatable valve and connecting the control valve to the actuatable valve and the actuatable discharge/mixing valve such that any loss of pressure in the control return line results in closing the actuatable valve and the actuatable discharge/mixing valve as pressure is released through the safety bleed. With such an arrangement various configurations are possible which provide various redundancies in operator safety. These configurations may include, in one or more arrangements, an actuatable valve, an actuate able discharge/mixing valve, a safety bleed, and/or nozzle safety shutoff device.

32 Claims, 2 Drawing Sheets

DEADMAN CONTROL METHOD AND APPARATUS

FILED OF THE INVENTION

The present invention relates to the field of control systems for mixing equipment, and more particularly to a new and improved emergency shutdown system and method.

BACKGROUND OF THE INVENTION

At a blast pressure of 100 psi, a grain of abrasive shooting from the mouth of a wide-throat long venturi blast nozzle hits its target at 420 miles per hour. The velocity increases to approximately 850 miles per hour —faster than the speed of sound —at 150 psi. The Occupational Health and Safety Organization (OSHA) requires a safety system on all abrasive blasting equipment as well as on other equipment. Such safety systems usually include what is referred to in the art as a "deadman's control." A deadman's control is a device that stops the machinery when the control is released. As is well known, these controls have been implemented as mechanical, pneumatic and electric deadman controls. To insure worker safety, these deadman's controls should be reliable, safe, and activate under of a variety of predictable and unpredictable conditions, such as accidental start-up, operator error, etc.

As is well known, deadman's controls may be implemented at different locations within a system, such as an abrasive blasting system. One such implementation is to put the device which the deadman's apparatus actuates at a point in the system near the so-called mixing pot. In such an arrangement, when an operator holding a hose releases a deadman's control at or near a nozzle end, the device under its control at the mixing pot shuts flow to the hose. With such arrangement, there is typically a delay of several seconds before spray in the hose is shut down, resulting in continued flow at the nozzle, which then may lead to significant operator injury.

What is needed is a simple and effective deadman system and method to insure that flow is redundantly terminated without undue delay under a variety of conditions so as to provide operator safety.

SUMMARY OF THE INVENTION

In accordance with the principles of the invention a system is provided to include a power supply, an actuatable valve, the actuatable valve connected via a line between the power supply and a storage vessel, an actuatable discharge/mixing valve attached to a portion of the storage vessel, the actuatable discharge/mixing valve connected via a line between the actuatable valve and a hose, a terminal end of the hose having a nozzle, a control input line connecting the power supply to a control valve positioned adjacent to the nozzle, and a control return line having a safety bleed positioned adjacent to the actuatable valve and connecting the control valve to the actuatable valve and the actuatable discharge/mixing valve such that any loss of pressure in the control return line results in closing the actuatable valve and the actuatable discharge/mixing valve as pressure is released through the safety bleed. With such an arrangement various configurations are possible which provide various redundancies in operator safety. These configurations may include, in one or more arrangements, an actuatable valve, an actuate able discharge/mixing valve, a safety bleed, and/or nozzle safety shutoff device.

BRIEF DESCRIPTION OF THE DRAWINGS

The novel features believed characteristic of the invention are set forth in the appended claims. The invention itself, however, as well as features and advantages thereof, will be best understood by reference to the detailed description of specific embodiments which follows, when read in conjunction with the accompanying drawings, wherein:

DESCRIPTION OF THE PREFERRED EMBODIMENT(S)

Figure 1:
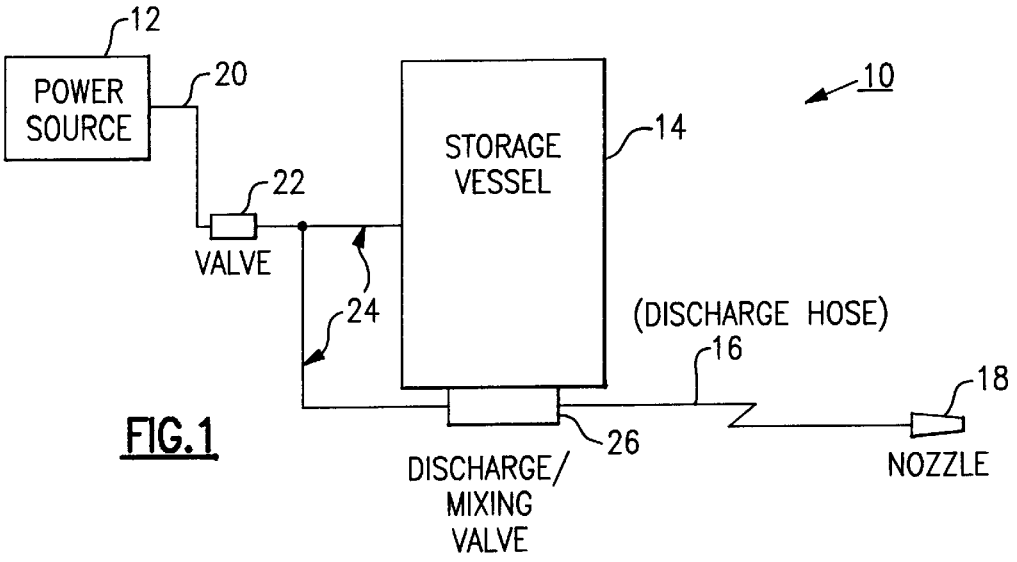
FIG. 1 is a block diagram of an exemplary manual mixing system having no deadman's control for operator safety.

Referring to FIG. 1, a typical mixing system 10 is shown to include a power source 12, a storage vessel 14, and a discharge hose 16 terminating in a nozzle 18. A first line 20 connects the power source 12 to a valve 22. A second line 24 feeds into the storage vessel 14 and/or to a discharge/mixing valve 26. The discharge hose 16 connects the discharge/mixing valve 26 to the nozzle 18.

An exemplary power source 12 may be a compressor that drives air, water, or other compressed gas or fluid. The mixing system 10 need not be under pressure. By way of example, the description of FIG. 1 will use an air compressor as the power source 12 and the system 10 which be operating under pressure. The valve 22 provides a flow of air from the power source 12 to both the storage vessel 14 and the discharge/mixing valve 26. Air entering the storage vessel 14 from the valve 22 pressurizes the storage vessel 14, forcing the contents of the storage vessel 14 towards the discharge/mixing valve 26, wherein the contents mixes with air coming directly from the valve 22. The mixed air and contents are forced through the discharge hose 16 and out the nozzle 18. Proportioning of the air and storage vessel 14 contents occurs at the discharge/mixing valve, as well as turn on/shut off of the system 10. Thus, an operator adds contents to the storage vessel 14, starts the compressor 12, open valve 22, adjusts the mixture of air and contents and starts flow of material at the discharge/mixing valve 26, holds the nozzle 18 and material exits at the nozzle 18 under pressure.

The system 10 described above contains no operator safety feature(s). Thus, if an emergency occurs, such as the operator dropping the discharge hose 16 and/or the nozzle 18, or a break occurs in the discharge hose 16, material under pressure will continue to flow from the system 10 until the operator or his assistant can manually close the discharge/mixing valve 26 or terminate power to the power source 12 or close valve 22. In the time it takes the operator to close the discharge/mixing valve 26 or the turn off the power to the power supply 12 or close valve 22 he may be severely injured by the continuing material spray from the system 10. Further, property of the environment may be compromised if the spray needs to be controlled or contained.

To begin to protect the operator, a control system that automatically shuts the system 10 down without undue delay is desired. Such a system would terminate the pressurized contents from discharging at the nozzle 18 by stopping material at the nozzle 18, or bringing the pressure in the storage vessel 14 to zero, or closing the discharge/mixing value 26, or one of several combinations of these.

Figure 2:
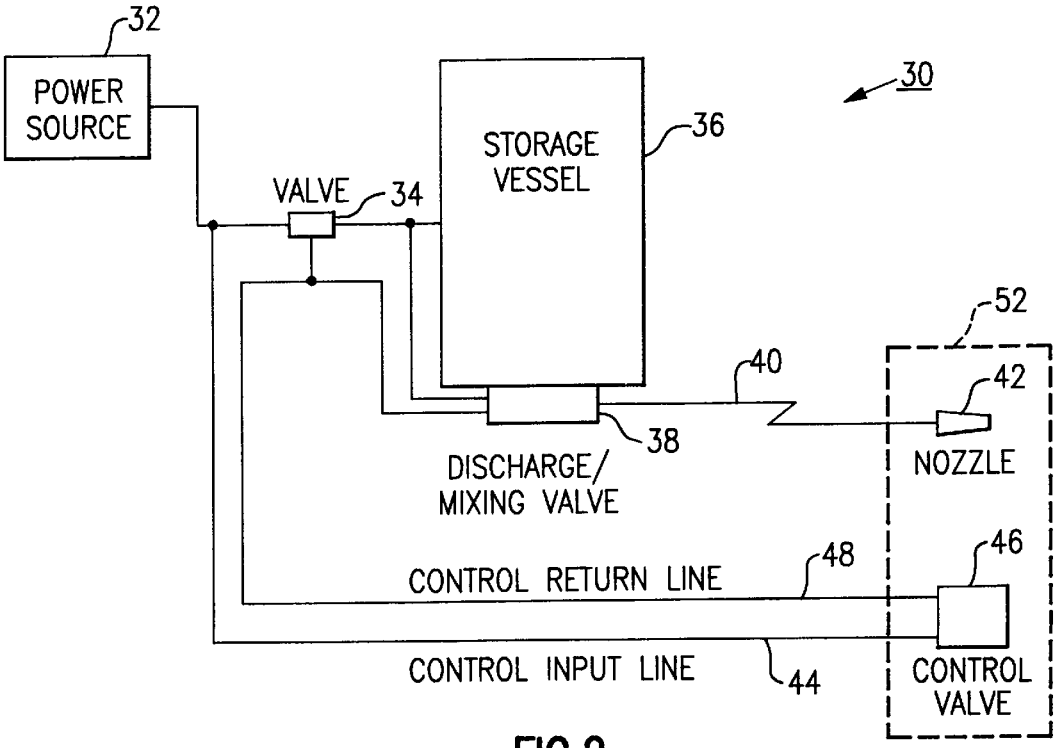
FIG. 2 is a block diagram of an exemplary mixing system having a first embodiment of a deadman's shutoff.

Referring to FIG. 2, like the system 10 described with reference to FIG. 1, an exemplary system 30 includes an air compressor 32, a valve 34, a storage vessel 36, a discharge/mixing valve 38, a hose 40, and a nozzle 42. The valve 34 may be manual, or may contain one or more components that include an on/off control and a means to vent. Additionally, the system 30 includes a control input line 44, a control valve 46, and a control return line 48. Although the nozzle 42 and the control valve 46 are shown as separated, they may be integrated into a single nozzle end safety unit 52, shown in tandem.

As used and described in the exemplary system 30, the valve 34 and the discharge/mixing valve 38 are pneumatically controlled, i.e., actuated, by the operation of the combination of the control input line 44, the control valve 46, and pressurizing the control return line 48. One skilled in this art will see that the valve 34 and/or the discharge/mixing valve 38 may be controlled by fluid pressure, electrical control, or hydrostatic control, to mention a few by way of examples. Depending on the implementation used (fully described below), the system 30 may contain the actuatable valve 34, or the discharge/mixing valve 38, or both the valve 34 and the discharge/mixing valve 38.

During operation, the operator turns on the power supply 32, holds the nozzle 42, and opens the control valve 46, resulting in building air pressure in the control return line 48 actuating the valve 34, or the dischargelmixing valve 38, or if both are present in the system 30, actuating both.

The operation of each of the above configurations will now be described in turn.

In the system 30 where only the actuatable discharge/mixing valve 38 is present, during system 30 operation pressure in the control return line 48 opens the discharge/mixing valve 38. In the event of an operator emergency wherein the hose 40 is dropped or damaged, or the operator releases (i.e., closes) the control valve 46, air is released at the control valve 46 when it becomes deactuated, and pressure in the control return line 48 is lost. This lost pressure results in the closing of the discharge/mixing valve 38 and material flowing in the hose 40 towards the nozzle 42 slowly loses pressure and ceases to flow from the nozzle 42.

In the system 30 where only the actuatable valve 34 is present, during system 30 operation pressure in the control return line 48 opens the valve 34, which is now includes a blow down function. In the event of an operator emergency wherein the hose 40 is dropped or damaged, or the operator releases (i.e., closes) the control valve 46, air escapes at the control valve 46, and pressure in the control return line 48 is lost. This lost pressure results in the closing supply to valve 34 and discharging pressure in the storage vessel 36 to the atmosphere. The subsequent loss of pressure in the storage vessel 36 results in the material flowing in the hose 40 towards the nozzle 42 slowly losing pressure and flow slowing ceasing at the nozzle 42.

In the system 30 where both the actuatable discharge/mixing valve 38 and the valve 34 are present, during system 30 operation pressure in the control return line 48 opens the discharge/mixing valve 38 and the valve 34. In the event of an operator emergency wherein the hose 40 is dropped or damaged, or the operator releases (i.e., closes) the control valve 46, pressure in the control return line 48 is lost due to a bleeding of air at the control valve 46. This lost pressure results in the closing of the discharge/mixing valve 38 and actuating the valve 34 to bleed off pressure in the storage vessel 36, and material flowing in the hose 40 towards the nozzle 42 slowly loses pressure and ceases to exit the nozzle 42.

Each of three system configurations discussed above result in material continuing to flow out the nozzle 42 for some period of time during both a planned shutdown and in an emergency, until pressure leading to the nozzle 42 is lost. And in the event that the control return line 48 is kinked, pinched, creased, cracked or otherwise obstructed, as may be the case if a vehicle were to run over or stop on the control line 48, as one example, the system 30 would not be capable of shut down remotely by the system. Specifically, if the control return line 48 is kinked, for example, actuating pressure between the kink and the discharge/mixing valve 38 and/or valve 34 is maintained and no subsequent actuation occurs when may be needed or desired, render system control inoperable or ineffective. It should be noted that the control return line 48, as well as the control input line 44, is usually constructed of flexible material, and as such, is susceptible of kinking, pinching, etc.

Figure 3:
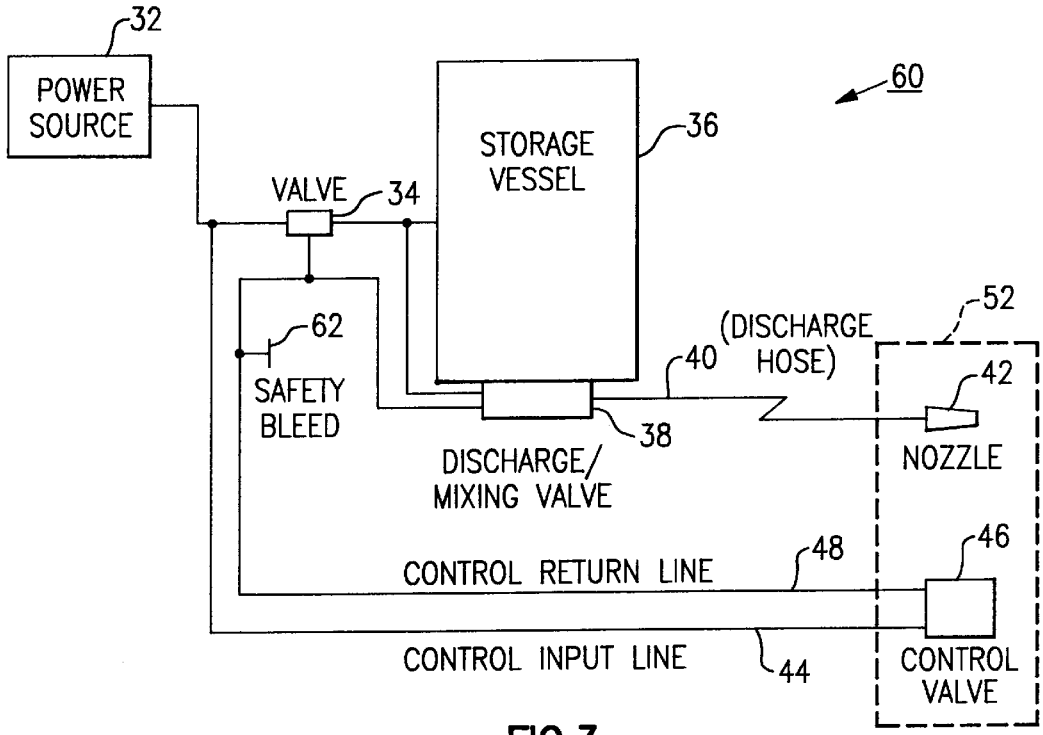
FIG. 3 is a block diagram of an exemplary mixing system having a second embodiment of a deadman's shutoff.

Referring now to FIG. 3, where like numbers are maintained for consistency, a system 60 is shown to include a safety bleed 62 adapted to the control return line 48. In operation, the control return line 48 is under pressure and a small amount of pressurized air is continuously allowed to escape to the atmosphere or into suitable containment (not shown) through the safety bleed 62. In the event that a kink in the control return line 48 occurs, all pressure in the control return line is released through the safety bleed. With the loss of pressure in the control return line 48, the system 60 shuts down as described in the three system 30 configurations fully described above with reference to FIG. 2. It is preferred that the location of the safety bleed 62 be such that no kink can occur between it and the system it actuates, such as the valve 34. Thus, it is most preferred to locate the safety bleed 62 in close proximity to the terminating device, such as the valve 34 or the storage vessel 36.

Utilizations of any of the systems configurations so far described still fail to address a problem of material continuing to exit the nozzle 42 for some period of time during system shutdown. In an alternate embodiment of the present invention, the nozzle 42 (of FIGS. 2 and 3) is fitted with a deadman nozzle safety shutoff unit, fully described below with reference to FIG. 4. This deadman nozzle safety shutoff unit introduces a further redundancy into the systems described in FIGS. 2 and 3 by shutting off material flow exiting at the nozzle 42 with a minimal amount of delay, delay which may result in serious injury to the operator.

Figure 4:
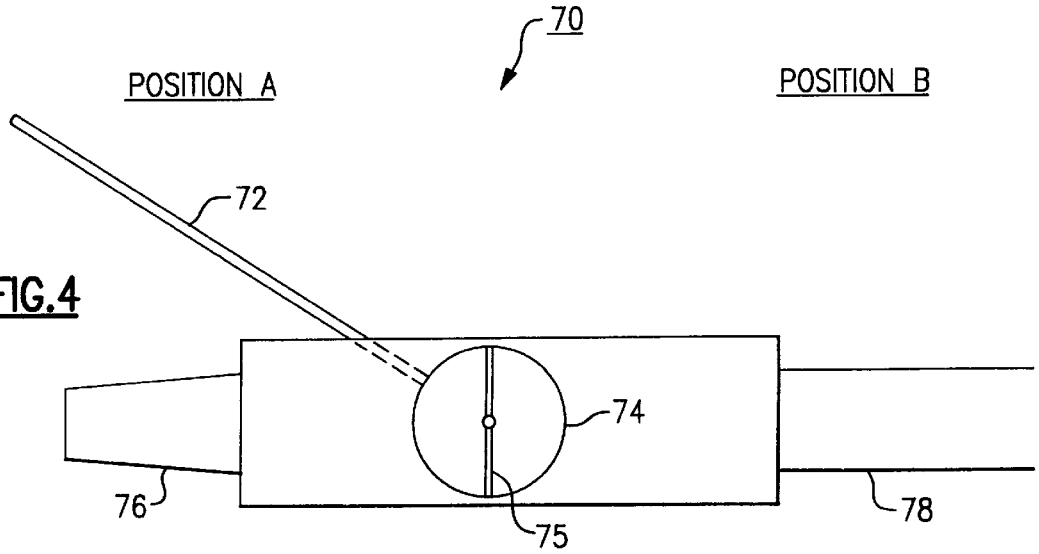
FIG. 4 is a block diagram of an exemplary nozzle system having a deadman's device.

Referring now to FIG. 4, a deadman nozzle safety shutoff unit 70 may be any on/off valve, preferably spring-loaded, and including an operator lever (shutoff arm) 72 connected to rotating shutoff valve 74. This shutoff arm 72 may alternatively be configured as a paddle and various other shapes, and may have a positive lock-out mechanism (not shown) which provides further safety. As shown in Position A, the shutoff valve 74, by way of one specific example, contains an internal gate 75 which prevents the flow of material from exiting a tip 76 by blocking the flow from a hose 78. When an operator wishes to have a flow of material exit the tip 76, the operator holds the unit 70 and draws the shutoff arm 72 to Position B, thereby rotating the internal gate 75 and opening a clear passage of material from the hose 78 to the tip 76. In the event that the operator releases the shutoff arm 72, it immediately re-sets to Position A and stops immediately without undue flow of material from the hose 78 to the tip 76.

As was mentioned above, the deadman nozzle safety shutoff unit may replace the nozzle 52 of FIGS. 2 and 3 and supplement any of the system configurations described in FIGS. 2 and 3.

Having described a preferred embodiment of the invention, it will now become apparent to those skilled in the art that other embodiments incorporating its concepts may be provided. It is felt therefore, that this invention should not be limited to the disclosed invention, but should be limited only by the spirit and scope of the appended claims.

What is claimed is:

1. A equipment system comprising:

a power supply;

an actuatable valve, the actuatable valve connected via a line between the power supply and a storage vessel;

an actuatable discharge/mixing valve attached to a portion of the storage vessel, the actuatable discharge/mixing valve connected via a line between the actuatable valve and a hose, a terminal end of the hose a nozzle;

a control input line connecting the power supply to a control valve positioned adjacent to the nozzle; and a control return line connecting the control valve to the actuatable valve and the actuatable discharge/mixing valve such that loss of pressure in the control return line results in closing the actuatable valve and the actuatable discharge/mixing valve.

2. The equipment system according to claim 1 wherein the nozzle and the control valve are manually and synchronously controlled by the user with a control aperture, the control aperture having a operating position and a non-operating position.

3. The equipment system according to claim 2 wherein the control aperture is spring loaded so as to remain in the non-operating position if left unattended.

4. An enhanced equipment system comprising:

a power supply;

an actuatable valve, the actuatable valve connected via a line between the power supply and a storage vessel;

an actuatable discharge/mixing valve attached to a portion of the storage vessel, the actuatable discharge/mixing valve connected via a line between the actuatable valve and a hose, a terminal end of the hose having a nozzle;

a control input line connecting the power supply to a control valve positioned adjacent to the nozzle; and a control return line having a safety bleed positioned adjacent to the actuatable valve and connecting the control valve to the actuatable valve and the actuatable discharge/mixing valve such that any loss of pressure in the control return line results in closing the actuatable valve and the actuatable discharge/mixing valve as pressure is released through the safety bleed.

5. The enhanced equipment system according to claim 4 wherein the nozzle and the control valve are manually and synchronously controlled by the user with a control aperture, the control aperture having a operating position and a non-operating position.

6. The enhanced equipment system according to claim 5 wherein the control aperture is spring loaded so as to remain in the non-operating position if left unattended.

7. A equipment system comprising:

a power supply;

an actuatable valve, the actuatable valve connected via a line between the power supply and a storage vessel;

an actuatable discharge/mixing valve attached to a portion of the storage vessel, the actuatable discharge/mixing valve connected via a line between the actuatable valve and a hose, a terminal end of the hose having a user operator safety shutoff;

a control input line connecting the power supply to a control valve positioned within the safety shutoff; and a control return line connecting the control valve of the safety shutoff to the actuatable valve and the actuatable discharge/mixing valve such that loss of pressure in the control return line results in closing the safety shutoff and the actuatable valve and the actuatable discharge/mixing valve.

8. The equipment system according to claim 7 wherein the nozzle and the control valve are manually and synchronously controlled by the user with a control aperture, the control aperture having a operating position and a non-operating position.

9. The equipment system according to claim 8 wherein the control aperture is spring loaded so as to remain in the non-operating position if left unattended.

10. The equipment system according to claim 9 wherein the control aperture is fitted with a lock-out mechanism.

11. An enhanced equipment system comprising:

a power supply;

an actuatable valve, the actuatable valve connected via a line between the power supply and a storage vessel;

an actuatable discharge/mixing valve attached to a portion of the storage vessel, the actuatable discharge/mixing valve connected via a line between the actuatable valve and a hose, a terminal end of the hose having a user safety shutoff;

a control input line connecting the power supply to a control valve of the safety shutoff; and a control return line having a safety bleed positioned adjacent to the actuatable valve and connecting the control valve of the safety shutoff to the actuatable valve and the actuatable discharge/mixing valve such that any loss of pressure in the control return line results in closing the safety shutoff and the actuatable valve and the actuatable discharge/mixing valve.

12. The enhanced equipment system according to claim 11 wherein the safety shutoff is manually controlled by the user with a control aperture, the control aperture having a operating position and a non-operating position.

13. The enhanced equipment system according to claim 12 wherein the control aperture is spring loaded so as to remain in the non-operating position if left unattended.

14. The enhanced equipment system according to claim 13 wherein the control aperture is fitted with a lock-out mechanism.

15. An enhanced equipment system comprising:

a power supply;

an actuatable valve, the actuatable valve connected via a line between the power supply and a storage vessel;

a discharge/mixing valve attached to a portion of the storage vessel, the discharge/mixing valve connected via a line between the valve and a hose, a terminal end of the hose having a nozzle;

a control input line connecting the power supply to a control valve positioned adjacent to the nozzle; and a control return line having a safety bleed positioned adjacent to the actuatable valve and connecting the control valve to the actuatable valve and the actuatable discharge/mixing valve such that any loss of pressure in the control return line results in closing the actuatable valve as pressure is released through the safety bleed.

16. An enhanced equipment system comprising:

a power supply;

a line between the power supply and a storage vessel;

an actuatable discharge/mixing valve attached to a portion of the storage vessel, the actuatable discharge/mixing valve receiving input pressure from the line and connected via a hose between the actuatable valve to a terminal end of the hose having a nozzle;

a control input line connecting the power supply to a control valve positioned adjacent to the nozzle; and a control return line having a safety bleed positioned adjacent to the actuatable discharge/mixing valve and connecting the control valve to the actuatable discharge/mixing valve such that any loss of pressure in the control return line results in closing the actuatable discharge/mixing valve as pressure is released through the safety bleed.

17. A equipment system comprising:

a power supply;

an actuatable valve, the actuatable valve connected via a line between the power supply and a storage vessel;

a discharge/mixing valve attached to a portion of the storage vessel, the discharge/mixing valve connected via a line between the actuatable valve and a hose, a terminal end of the hose having a user operator safety shutoff;

a control input line connecting the power supply to a control valve positioned within the safety shutoff; and a control return line connecting the control valve of the safety shutoff to the actuatable valve such that loss of pressure in the control return line results in closing the safety shutoff and the actuatable valve.

18. The equipment system according to claim 17 wherein the safety shutoff is manually controlled by the user with a control aperture, the control aperture having a operating position and a non-operating position.

19. The equipment system according to claim 18 wherein the control aperture is spring loaded so as to remain in the non-operating position if left unattended.

20. The equipment system according to claim 19 wherein the control aperture is fitted with a lock-out mechanism.

21. A equipment system comprising:

a power supply;

a valve, the valve connected via a line between the power supply and a storage vessel;

an actuatable discharge/mixing valve attached to a portion of the storage vessel, the actuatable discharge/mixing valve connected via a line between the valve and a hose, a terminal end of the hose having a user operator safety shutoff;

a control input line connecting the power supply to a control valve positioned within the safety shutoff; and a control return line connecting the control valve of the safety shutoff to the actuatable discharge/mixing valve such that loss of pressure in the control return line results in closing the safety shutoff and the actuatable discharge/mixing valve.

22. The equipment system according to claim 21 wherein the safety shutoff is manually controlled by the user with a control aperture, the control aperture having a operating position and a non-operating position.

23. The equipment system according to claim 22 wherein the control aperture is spring loaded so as to remain in the non-operating position if left unattended.

24. The equipment system according to claim 23 wherein the control aperture is fitted with a lock-out mechanism.

25. An enhanced equipment system comprising:

a power supply;

a valve, the valve connected via a line between the power supply and a storage vessel;

an actuatable discharge/mixing valve attached to a portion of the storage vessel, the actuatable discharge/mixing valve connected via a line between the valve and a hose, a terminal end of the hose having a user safety shutoff;

a control input line connecting the power supply to a control valve of the safety shutoff; and a control return line having a safety bleed positioned adjacent to the storage vessel and connecting the control valve of the safety shutoff to the actuatable discharge/mixing valve such that any loss of pressure in the control return line results in closing the safety shutoff and the actuatable discharge/mixing valve.

26. The enhanced equipment system according to claim 25 wherein the safety shutoff is manually controlled by the user with a control aperture, the control aperture having a operating position and a non-operating position.

27. The enhanced equipment system according to claim 26 wherein the control aperture is spring loaded so as to remain in the non-operating position if left unattended.

28. The enhanced equipment system according to claim 27 wherein the control aperture is fitted with a lock-out mechanism.

29. An enhanced equipment system comprising:

a power supply;

an actuatable valve, the actuatable valve connected via a line between the power supply and a storage vessel;

a discharge/mixing valve attached to a portion of the storage vessel, the discharge/mixing valve connected via a line between the actuatable valve and a hose, a terminal end of the hose having a user safety shutoff;

a control input line connecting the power supply to a control valve of the safety shutoff; and a control return line having a safety bleed positioned adjacent to the actuatable valve and connecting the control valve of the safety shutoff to the actuatable valve such that any loss of pressure in the control return line results in closing the safety shutoff and the actuatable valve.

30. The enhanced equipment system according to claim 29 wherein the safety shutoff is manually controlled by the user with a control aperture, the control aperture having a operating position and a non-operating position.

31. The enhanced equipment system according to claim 30 wherein the control aperture is spring loaded so as to remain in the non-operating position if left unattended.

32. The enhanced equipment system according to claim 31 wherein the control aperture is fitted with a lock-out mechanism.

* * * * *